US011640776B1

(12) United States Patent
Chen et al.

(10) Patent No.: US 11,640,776 B1
(45) Date of Patent: May 2, 2023

(54) ARCUATE DISPLAY DEVICE AND DRIVING METHOD THEREOF

(71) Applicant: AUO Corporation, Hsinchu (TW)

(72) Inventors: Yu-Chu Chen, Hsinchu (TW); Po Chun Lin, Hsinchu (TW); Chun-Hui Huang, Hsinchu (TW); Yu-Chi Kang, Hsinchu (TW); Yi-Hsiang Hu, Hsinchu (TW); Wei-Ting Chen, Hsinchu (TW)

(73) Assignee: AUO Corporation, Hsinchu (TW)

( * ) Notice: Subject to any disclaimer, the term of this patent is extended or adjusted under 35 U.S.C. 154(b) by 0 days.

(21) Appl. No.: 17/896,069

(22) Filed: Aug. 25, 2022

(30) Foreign Application Priority Data

Apr. 25, 2022 (TW) ..... 111115702

(51) Int. Cl.
*G09G 3/00* (2006.01)

(52) U.S. Cl.
CPC ..... *G09G 3/03* (2020.08); *G09G 2320/02* (2013.01)

(58) Field of Classification Search
CPC ..... G09G 3/03; G09G 2320/02
See application file for complete search history.

(56) References Cited

U.S. PATENT DOCUMENTS

2016/0253969 A1* 9/2016 Chen ..... G09G 3/03 345/214

FOREIGN PATENT DOCUMENTS

| | | | |
|---|---|---|---|
| CN | 102915680 A | * | 2/2013 |
| CN | 112233048 | | 3/2021 |
| EP | 2317500 | | 5/2011 |
| WO | 2019232877 | | 12/2019 |

* cited by examiner

*Primary Examiner* — Abhishek Sarma
(74) *Attorney, Agent, or Firm* — JCIPRNET

(57) ABSTRACT

An arcuate display device, including an arcuate display surface, a plurality of display units, an image source, and a controller, is provided. The display units are configured on the arcuate display surface in an array manner, and each of the display units includes a plurality of pixels. The controller is configured to receive a plurality of pixel signals from the image source to generate a plurality of frame signals respectively corresponding to the display units. Each of the frame signals includes the pixel signals, a plurality of first dummy signals, and a plurality of second dummy signals, in which the pixel signals respectively correspond to the pixels. A sum of an amount of the pixel signals, an amount of the first dummy signals, and an amount of the second dummy signals in each of the frame signals is same. A driving method of the arcuate display device is also provided.

12 Claims, 5 Drawing Sheets

ARCUATE DISPLAY DEVICE AND DRIVING METHOD THEREOF

CROSS-REFERENCE TO RELATED APPLICATION

This application claims the priority benefit of Taiwan application serial no. 111115702, filed on Apr. 25, 2022. The entirety of the above-mentioned patent application is hereby incorporated by reference herein and made a part of this specification.

BACKGROUND

Technical Field

The present disclosure relates to a non-planar display device and a driving method thereof, in particular to an arcuate display device and a driving method thereof.

Description of Related Art

With an increasing development of technology industries, displays have been widely used in daily life. By splicing a plurality of display units (light panels) on an arcuate surface, an arcuate display device can provide an experience different from a flat display and is often used in large-scale exhibition activities.

However, since a display surface of the arcuate display device is non-planar, taking a spherical display device as an example, amounts of pixels possessed by display units at north and south ends are smaller than those possessed by display units at an equator. When an image source controls the display units of different latitudes by a driving device with a same circuit layout design as a flat display device, discontinuous images may occur at splicing areas of the adjacent light panels.

SUMMARY

The present disclosure provides an arcuate display device and a driving method thereof, in which images at splicing areas of the arcuate display device are continuous.

According to an embodiment of the present disclosure, an arcuate display device is provided, which includes an arcuate display surface, a plurality of display units, a virtual axis, an image source, and at least one controller. The display units are configured on the arcuate display surface in an array manner, and each of the display units includes a plurality of display rows, and each of the display rows includes a plurality of pixels. The virtual axis is located on the arcuate display surface, in which the display units are respectively configured on two sides of the virtual axis, and the display rows are configured parallel to the virtual axis. The image source is configured to provide a plurality of pixel signals. The at least one controller is electrically connected between the display units and the image source. The controller is configured to receive the pixel signals and generate a plurality of frame signals respectively corresponding to the display units by using a frame signal generator of the controller, in which each of the frame signals includes the pixel signals, a plurality of first dummy signals and a plurality of second dummy signals, and the pixel signals respectively correspond to the pixels. A sum of an amount of the pixel signals, an amount of the first dummy signals, and an amount of the second dummy signals in each of the frame signals is same.

According to an embodiment of the present disclosure, a driving method of an arcuate display device is provided for driving the arcuate display device. The arcuate display device includes a plurality of display units, an image source and at least one controller. The at least one controller is electrically connected between the display units and the image source. The driving method of the arcuate display device includes the following. The image source provides a plurality of pixel signals. The at least one controller receives the pixel signals, and a plurality of frame signals respectively corresponding to the display units are generated using a frame signal generator of the at least one controller. Each of the frame signals includes the pixel signals, a plurality of first dummy signals and a plurality of second dummy signals. A sum of an amount of the pixel signals, an amount of the first dummy signals, and an amount of the second dummy signals in each of the frame signals is same.

Based on the above, the driving method of the arcuate display device provided by the embodiment of the present disclosure inserts the dummy signals into the frame signals, so that the sum of the amounts of the pixel signals, the amounts of the first dummy signals and the amounts of the second dummy signals in each of the frame signals is the same. Therefore, the display units which possess different amounts can be controlled using the frame signal generator and a driving device with the same circuit layout design, so there will be no discontinuous images at the splicing areas.

In order to make the above-mentioned features and advantages of the present disclosure more obvious and easier to understand, embodiments will be given and described in detail hereinafter with reference to the accompanying drawings.

DESCRIPTION OF THE EMBODIMENTS

Figure 1A:
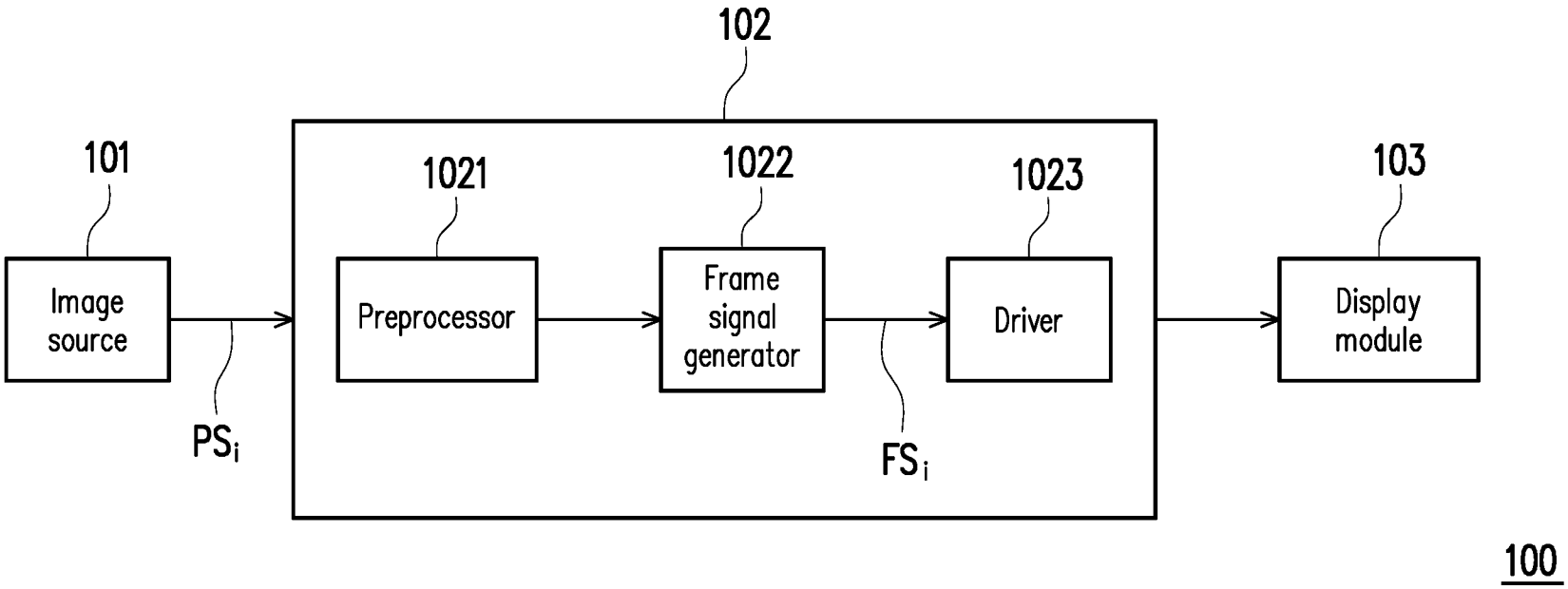
FIG. 1A is a schematic diagram of an arcuate display device according to an embodiment of the present disclosure.
Figure 1B:
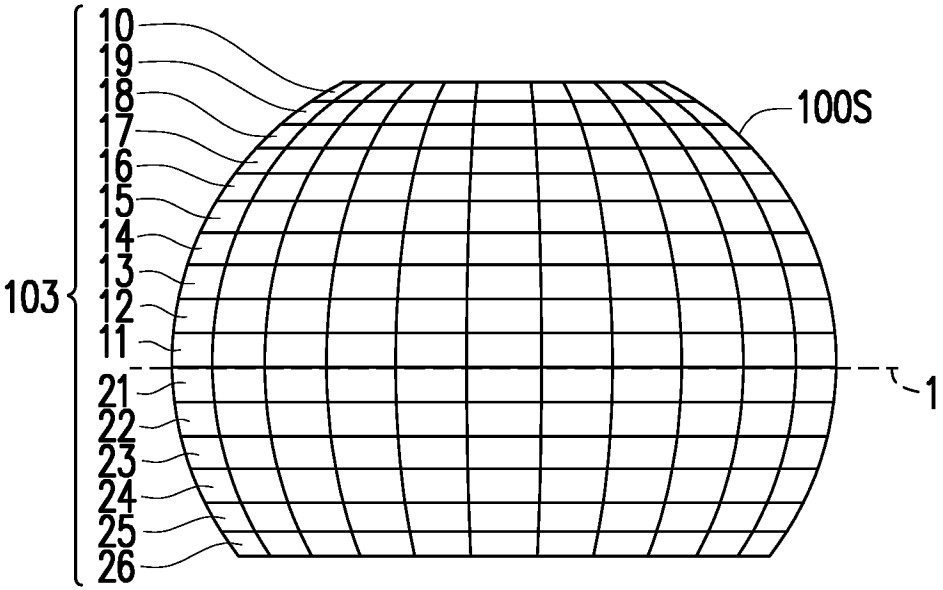
FIG. 1B is a schematic diagram of an arcuate display screen according to an embodiment of the present disclosure.

Referring to FIGS. 1A and 1B, FIG. 1A illustrates a schematic diagram of an arcuate display device according to an embodiment of the present disclosure, and FIG. 1B illustrates a schematic diagram of an arcuate display screen according to an embodiment of the present disclosure. An arcuate display device 100 includes an image source 101, a controller 102 and an arcuate display screen, in which the arcuate display screen includes an arcuate display surface 100S, a virtual axis 1 and a display module 103. The display module 103 includes a plurality of display units 11, 12, 13, 14, 15, 16, 17, 18, 19, 10, 21, 22, 23, 24, 25, 26.

The image source 101 is configured to provide a plurality of pixel signals PSi. The controller 102 is electrically connected between the display module 103 and the image source 101 and receives the pixel signals PSi to control the display units 11, 12, 13, 14, 15, 16, 17, 18, 19, 10, 21, 22, 23, 24, 25, 26. For convenience of description, only one controller 102 is illustrated in FIG. 1A, which is electrically connected to the display module 103. But the present disclosure is not limited hereto. In other embodiments of the present disclosure, the arcuate display device 100 may include a plurality of controllers 102 to respectively control the display units 11, 12, 13, 14, 15, 16, 17, 18, 19, 10, 21, 22, 23, 24, 25, 26. For example, one controller controls a plurality of the display units 11, 12, 13, one controller controls a plurality of the display units 14, 15, 16, one controller controls a plurality of the display units 17, 18, 19, 10, one controller controls a plurality of the display units 21, 22, 23, and another controller controls a plurality of the display units 24, 25, 26.

The display units are configured on the arcuate display surface 100S in an array manner. The virtual axis 1 is located on the arcuate display surface 100S, and the display units 11, 12, 13, 14, 15, 16, 17, 18, 19, 10, 21, 22, 23, 24, 25, 26 are respectively configured on two sides of the virtual axis 1. In the embodiment, the virtual axis 1 can be regarded as an equator of the arcuate display screen, and the display units 11, 12, 13, 14, 15, 16, 17, 18, 19, 10, 21, 22, 23, 24, 25, 26 are respectively configured on the arcuate display screen at different latitudes.

Figure 1C:
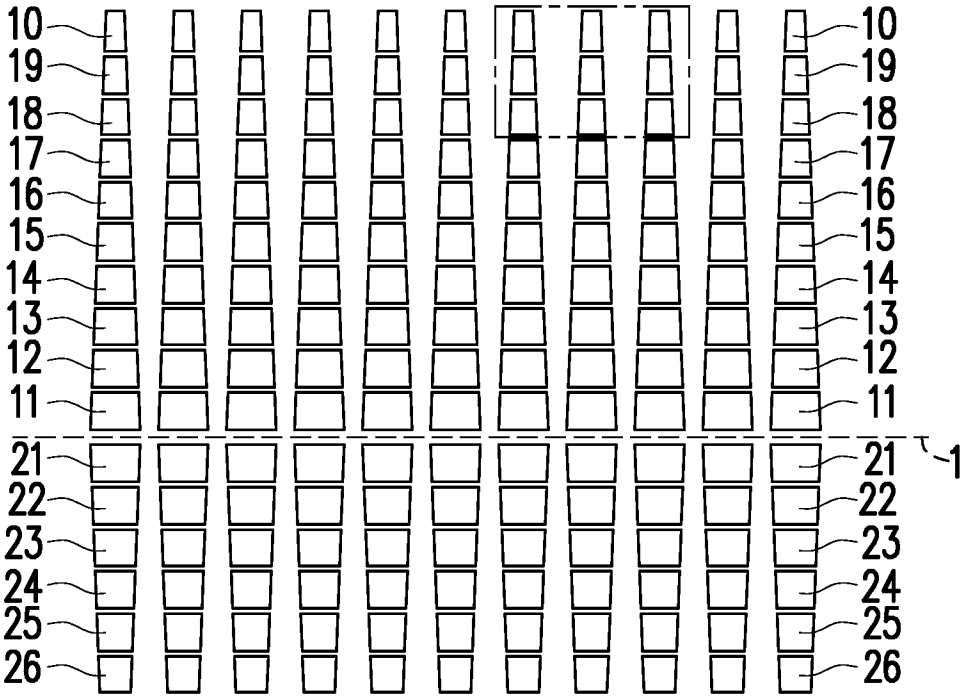
FIG. 1C is a schematic flat expansion view of the arcuate display screen shown in FIG. 1B.

Referring to FIG. 1B and FIG. 1C, FIG. 1C is a schematic flat expansion view of the arcuate display screen shown in FIG. 1B. In FIG. 1C, each display unit 11, 12, 13, 14, 15, 16, 17, 18, 19, 10, 21, 22, 23, 24, 25, 26 has a trapezoidal shape. A plurality of the display units 11 are arranged at positions with same minimum distance as a virtual axis 1. A plurality of the display units 12 are arranged at positions with same minimum distance as the virtual axis 1. The minimum distance between each display unit 12 and the virtual axis 1 is greater than the minimum distance between each display unit 11 and the virtual axis 1, and so on. Likewise, a plurality of the display units 21 are arranged at positions with same minimum distance as the virtual axis 1. A plurality of the display units 22 are arranged at positions with same minimum distance as the virtual axis 1. The minimum distance between each display unit 22 and the virtual axis 1 is greater than the minimum distance between each display unit 21 and the virtual axis 1, and so on.

Figure 2A:
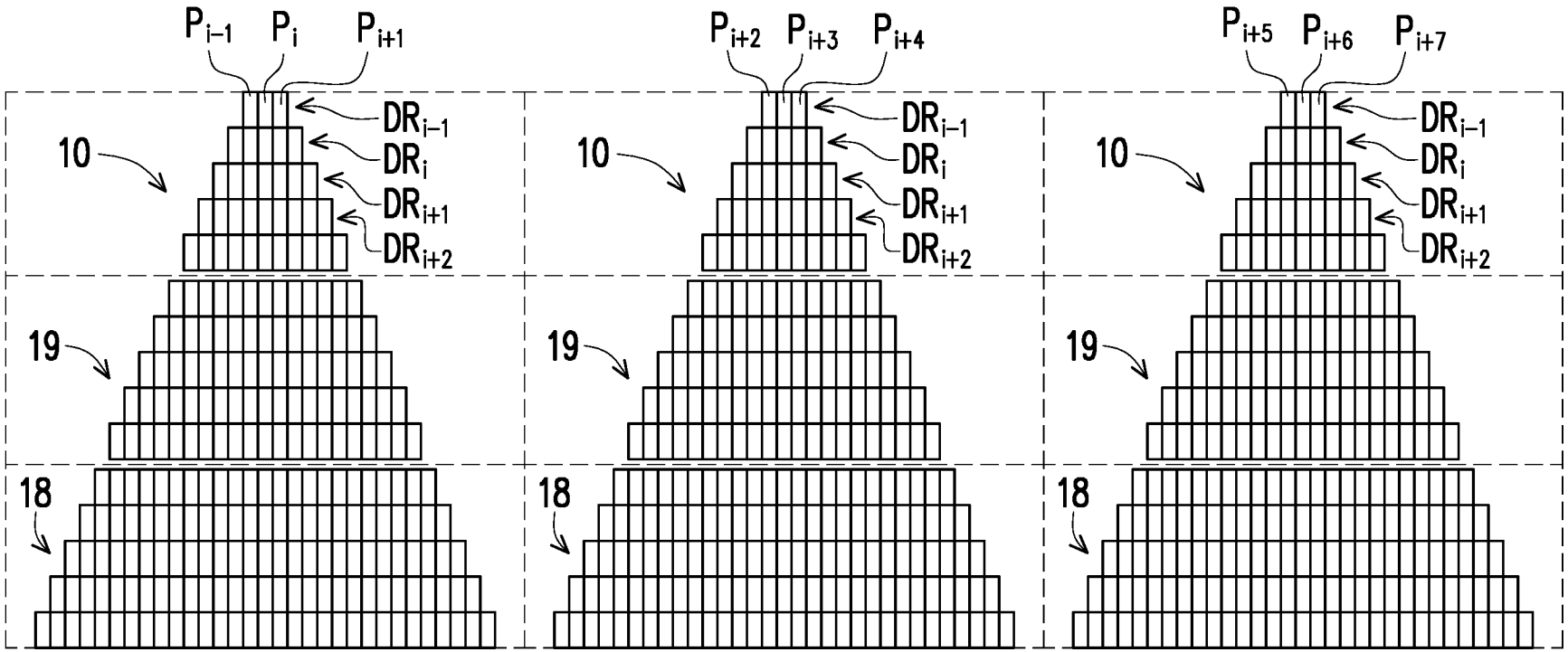
FIG. 2A is an enlarged view of a plurality of display units shown in FIG. 1C.

Referring to FIG. 1C and FIG. 2A, FIG. 2A illustrates an enlarged view of the nine display units within a dotted frame in FIG. 1C. The nine display units are respectively three display units 10, three display units 19 and three display units 18, and the nine display units are electrically connected to an image source 101 by a same controller 102. In addition, each of the display units 10, 19 and 18 includes a plurality of display rows DRi (the display rows DRi−1, DRi, DRi+1, and DRi+2 as shown in FIG. 2A, hereinafter collectively referred to as the display rows $DR_i$ for convenience of description), and each of the display rows DRi includes a plurality of pixels Pi. Each of the display rows DRi is configured parallel to the virtual axis 1.

As shown in FIG. 2A, the display row DRi closer to the virtual axis 1 includes more pixels Pi. That is, the display unit closer to the virtual axis 1 includes more pixels Pi. Display units having a same distance from the virtual axis 1 have a same amount of the pixels Pi. Specifically, in FIG. 2A, the three display units 10 have a same amount of the pixels Pi, the three display units 19 have a same amount of the pixels Pi, and the three display units 18 have a same amount of the pixels Pi. On the other hand, the amount of the pixels Pi included in the display units 10 is smaller than the amount of the pixels Pi included in the display units 19, and the amount of the pixels Pi included in the display units 19 is smaller than the amount of the pixels Pi included in the display units 18.

It should be noted that since FIG. 1C is the schematic flat expansion view of the arcuate display screen shown in FIG. 1B, and FIG. 2A is the enlarged view of the nine display units shown in FIG. 1C, although pixels Pi+1 and Pi+2 are not illustrated as adjacent to each other in FIG. 2A, the two pixels Pi+1 and Pi+2 are substantially adjacent in FIG. 1B and are respectively located on two sides of a splice line between two adjacent display units 10. Likewise, although pixels Pi+4 and Pi+5 are not illustrated as adjacent to each other in FIG. 2A, the two pixels Pi+4 and Pi+5 are substantially adjacent in FIG. 1B and are respectively located on two sides of a splice line between two adjacent display units 10. The adjacent relationship between the pixels of the different display units is not limited to the display row DRi−1 shown in FIG. 2A, but also applies to other display rows DRi, DRi+1 and DRi+2, etc., which will not be described here.

Referring back to FIG. 1A, the controller 102 includes a preprocessor 1021, a frame signal generator 1022 and a driver 1023. The preprocessor 1021 is arranged to temporarily store and preprocess the pixel signals PSi from the image source 101. The frame signal generator 1022 is arranged to generate a plurality of frame signals FSi, and each of the frame signals FSi corresponds to one display unit. The driver 1023 is electrically connected between the frame signal generator 1022 and the display module 103 and drives the corresponding display unit in the display module 103 according to each of the frame signals FSi.

Figure 2B:
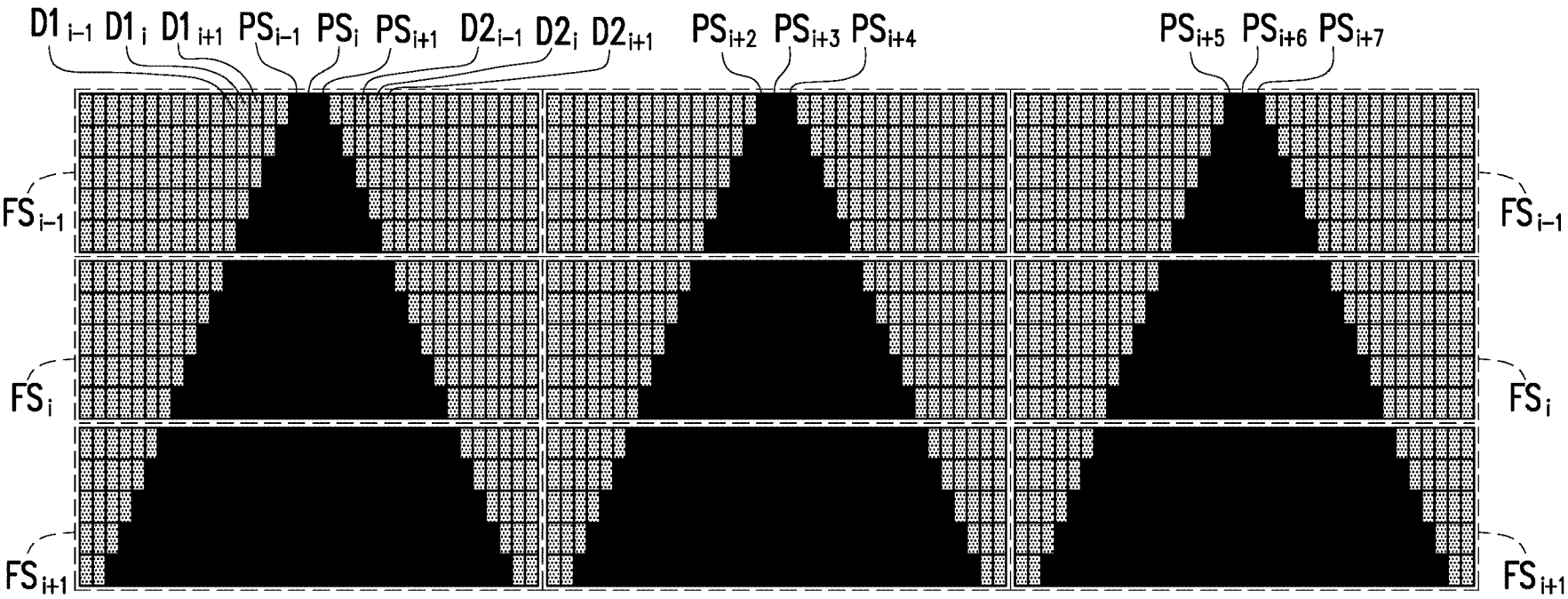
FIG. 2B is a schematic diagram of frame signals corresponding to the display units shown in FIG. 2A.

Referring to FIG. 2A and FIG. 2B, FIG. 2B illustrates nine frame signals FSi (the nine frame signals FSi−1, FSi, FSi+1, etc., as shown in FIG. 2B, hereinafter collectively referred to as the frame signals FSi for convenience of description) respectively corresponding to the nine display units of display units 10, display units 19 and display units 18 shown in FIG. 2A. As shown in FIG. 2B, each of the frame signals FSi is a two-dimensional array signal and includes a plurality of pixel signals PSi (the pixel signals PSi−1, PSi, PSi+1, PSi+2, PSi+3, PSi+4, PSi+5, PSi+6, and PSi+7 as shown in FIG. 2B, hereinafter collectively referred to as the pixel signals PSi for convenience of description). Moreover, each of the frame signals FSi also inserts a plurality of first dummy signals D1*i* (the first dummy signals D1*i*−1, D1*i*, D1*i*+1 as shown in FIG. 2B, hereinafter collectively referred to as the first dummy signals D1*i* for convenience of description), and a plurality of second dummy signals D2*i* (the second dummy signals D2*i*−1, D2*i*, D2*i*+1 as shown in FIG. 2B, hereinafter collectively referred to as the second dummy signals D2*i* for convenience of description), and the pixel signals PSi are located between the first dummy signals D1*i* and the second dummy signals D2*i*.

As shown in FIG. 2A and FIG. 2B, an amount of rows of the frame signal FSi−1 is the same as an amount of rows of the corresponding display units 10 (5 rows is shown as an example, but the present disclosure is not limited hereto), and an amount of the pixel signals PSi possessed by the frame signal FSi−1 is the same as the amount of the pixels Pi possessed by the corresponding display units 10, and corresponding patterns are formed in FIG. 2A and FIG. 2B respectively. Similarly, an amount of rows of the frame signal FSi is the same as an amount of rows of the corresponding display units 19, and an amount of the pixel signals PSi possessed by the frame signal FSi is the same as the amount of the pixels Pi possessed by the corresponding display units 19, and corresponding patterns are formed in FIG. 2A and FIG. 2B respectively. An amount of rows of the frame signal FSi+1 is the same as an amount of rows of the corresponding display units 18, and an amount of the pixel signals PSi possessed by the frame signal FSi+1 is the same as the amount of the pixels Pi of possessed by the corresponding display units 18, and corresponding patterns are formed in FIG. 2A and FIG. 2B respectively.

Furthermore, although the amount of the pixel signals PSi of the frame signal FSi−1, the amount of the pixel signals PSi of the frame signal FSi, and the amount of pixel signals PSi of the frame signal FSi+1 are different, a sum of the amount of the pixel signals PSi, an amount of the first dummy signals D1*i*, and an amount of the second dummy signals D2*i* in the frame signals FSi−1, FSi, and FSi+1 is the same. That is, although the amount of the pixels Pi possessed by the display units 10, the amount of the pixels Pi possessed by the display unit 19, and the amount of the pixels Pi possessed by the display unit 18 are different, by the method of inserting the first dummy signals D1*i* and the second dummy signals D2*i* into each frame signals FSi, the total amount of the signals in the frame signals FSi−1, FSi, and FSi1 is the same, so that the display units 10, 19 and 18 can be driven using the frame signals generated by a same frame signal generator 1022. In other embodiments of the present disclosure, the three display units 10, 19 and 18 can be driven using a different frame signal generator 1022 with a same circuit layout design. Moreover, although the amount of the pixels Pi possessed by the display unit 10, the amount of the pixels Pi possessed by the display unit 19, and the amount of the pixels Pi possessed by the display unit 18 are different, the three display units 10, 19, and 18 can also be driven using a same driver 1023. Specifically, by inserting the first dummy signals D1*i* and the second dummy signals D2*i*, the display units 10, 19, and 18 possess different amounts of pixels when located at different latitudes on the arcuate display screen and can be driven using the frame signal generator and the driver of the same circuit layout design, and there is no need to design frame signal generators and drivers with different circuit layout designs for the display units at different latitudes.

Furthermore, in each of the frame signals FSi, the amount of the first dummy signals D1*i* and the amount of the second dummy signals D2*i* are the same, and are arranged symmetrically relative to the pixel signals PSi. As shown in FIG. 2B, in the embodiment, each of the frame signals FSi is also a two-dimensional rectangular array as frame signals of a flat display. Therefore, the display units 10, 19, 18 can be driven using a frame signal generator of the flat display. Specifically, by inserting the first dummy signals D1*i* and the second dummy signals D2*i*, the display units 10, 19, and 18 possess a trapezoidal shape when located at different latitudes on the arcuate display screen, and can be driven using the frame signal generator and the driver of the flat display suitable for trapezoidal shapes.

In addition, for the display row DRi−1 shown in FIG. 2A and the pixel signals PSi shown in FIG. 2B corresponding to the row, since the continuous pixel signals PSi−1, PSi, PSi+1, PSi+2, PSi+3, PSi+4, PSi+5, PSi+6, PSi+7 from the image source 101 are grouped into a first group of pixel signals as shown in FIG. 2B (composed of the pixel signals PSi−1, PSi, PSi+1), a second group of pixel signals (composed of the pixel signals PSi+2, PSi+3, and PSi+4) and a third group of pixel signals (composed of the pixel signals PSi+5, PSi+6, PSi+7), and the first dummy signals D1*i* and the second dummy signals D2*i* are inserted between the first group of pixel signals and the second group of pixel signals and between the second group of pixel signals and the third group of pixel signals, so that each of the pixels Pi can receive correct pixel signals PSi (as shown in FIG. 2A and FIG. 2B, the pixel signals PSi−1, PSi, PSi+1, PSi+2, PSi+3, PSi+4, PSi+5, PSi+6, PSi+7 respectively correspond to pixels Pi−1, Pi, Pi+1, Pi+2, Pi+3, Pi+4, Pi+5, Pi+6, Pi+7). Therefore, substantially the pixels Pi−1, Pi, Pi+1, Pi+2, Pi+3, Pi+4, Pi+5, Pi+6, Pi+7 configured adjacently receive the continuous pixel signals PSi−1, PSi, PSi+1, PSi+2, PSi+3, PSi+4, PSi+5, PSi+6, PSi+7, and even if the pixel Pi+1 and the pixel Pi+2 respectively belong to the different display units, images displayed by the pixel Pi+1 and the pixel Pi+2 are continuous.

Similar to how the display row DRi−1 display the continuous images, since a pattern formed by the pixel signals PSi in each of the frame signals FSi shown in FIG. 2A corresponds to a pattern formed by the pixels Pi in the corresponding display units in FIG. 2B (the patterns are the same), the images at the splicing areas between the nine display units of display units 10, 19, and 18 in FIG. 2A are all continuous.

More broadly, by inserting an appropriate amount of the first dummy signals D1*i* and the second dummy signals D2*i*, each of the display units 11, 12, 13, 14, 15, 16, 17, 18, 19, 10, 21, 22, 23, 24, 25, 26 of the arcuate display device 100 can be driven using the different frame signal generator with the same circuit layout design, or can be driven using the same frame signal generator, and the images at the splicing areas between the display units are all continuous. For example, a lower amount of the first dummy signals D1*i* and the second dummy signals D2*i* are inserted into the display units 11 and 21, and a higher amount of the first dummy signals D1*i* and the second dummy signals D2*i* are inserted into the display units 16 and 26, so that a total amount of the signals in each of the frame signals, corresponding to the display units 11, 21 or the display units 16, 26, is the same. In this case, the display units 11, 21, 16 and 26 can be driven using the different frame signal generator with the same circuit layout design. By analogy, the display units 11, 12, 13, 14, 15, 16, 17, 18, 19, 10, 21, 22, 23, 24, 25, 26 of the arcuate display device 100 can be driven using the different frame signal generator with the same circuit layout design.

Referring to FIG. 1A, FIG. 1B, and FIG. 2B, a driving method of the arcuate display device is provided for driving the arcuate display device 100 according to an embodiment of the present disclosure. The driving method of the arcuate display device includes: providing the pixel signals PSi from the image source 101; receiving the pixel signals PSi using the controller 102; generating the frame signals FSi respectively corresponding to the display units 11, 12, 13, 14, 15, 16, 17, 18, 19, 10, 21, 22, 23, 24, 25, and 26 using the frame signal generator 1022 of the controller 102 the, in which the first dummy signals D1*i* and the second dummy signals D2*i* are inserted between the pixel signals PSi; and driving the corresponding display units 11, 12, 13, 14, 15, 16, 17, 18, 19, 10, 21, 22, 23, 24, 25, or 26 according to the frame signals FSi using the driver 1023. Each of the frame signals FSi includes the pixel signals PSi, the first dummy signals D1*i* and the second dummy signals D2*i*, and a sum of the amount of the pixel signals PSi, the amount of the first dummy signals D1*i*, and the amount of the second dummy signals D2*i* in each of the frame signals is the same FSi.

To sum up, the driving method of the arcuate display device provided by an embodiment of the present disclosure inserts the dummy signals into the frame signals, so that the sum of the amount of the pixel signals, the amount of the first dummy signals, and the amount of the second dummy signals in each of the frame signals is the same. Therefore, display units which possess different amounts can be controlled using the frame signal generator and a driving device with the same circuit layout design, so there will be no discontinuous images at the splicing areas.

What is claimed is:

1. An arcuate display device, comprising:

an arcuate display surface;

a plurality of display units, configured on the arcuate display surface in an array manner, wherein each of the display units comprises a plurality of display rows, and each of the display rows comprises a plurality of pixels;

a virtual axis, located on the arcuate display surface, wherein the display units are respectively configured on two sides of the virtual axis, and the display rows are configured parallel to the virtual axis;

an image source, configured to provide a plurality of pixel signals; and at least one controller, electrically connected between the display units and the image source, and configured to receive the pixel signals and generate a plurality of frame signals respectively corresponding to the display units using a frame signal generator of the at least one controller, wherein each of the frame signals comprises the pixel signals, a plurality of first dummy signals, and a plurality of second dummy signals, and the pixel signals respectively correspond to the pixels, wherein a sum of an amount of the pixel signals, an amount of the first dummy signals, and an amount of the second dummy signals in each of the frame signals is same.

2. The arcuate display device according to claim 1, wherein in each of the frame signals, the amount of the first dummy signals is same as the amount of the second dummy signals.

3. The arcuate display device according to claim 1, wherein the amount of the pixel signals of each of the frame signals is same as an amount of the pixels in the corresponding display unit.

4. The arcuate display device according to claim 1, wherein the display units having a same distance from the virtual axis have a same amount of the pixels.

5. The arcuate display device according to claim 1, wherein the at least one controller further comprises a driver electrically connected between the frame signal generator and the display units, and the driver drives the corresponding display units according to the frame signals.

6. The arcuate display device according to claim 1, wherein each of the frame signals is a two-dimensional array signal formed by the pixel signals, the first dummy signals, and the second dummy signals, and the pixel signals are located between the first dummy signals and the second dummy signals.

7. The arcuate display device according to claim 6, wherein an amount of rows of the two-dimensional array signal is same as an amount of rows of the display rows of the corresponding display unit.

8. A driving method of an arcuate display device for driving the arcuate display device, wherein the arcuate display device comprises a plurality of display units, an image source, and at least one controller, and the at least one controller is electrically connected between the display units and the image source, the driving method of the arcuate display device comprising:

providing a plurality of pixel signals by the image source;

receiving the pixel signals by the at least one controller; and generating a plurality of frame signals respectively corresponding to the display units using a frame signal generator of the at least one controller, wherein each of the frame signals comprises the pixel signals, a plurality of first dummy signals, and a plurality of second dummy signals, and a sum of an amount of the pixel signals, an amount of the first dummy signals, and an amount of the second dummy signals in each of the frame signals is same.

9. The driving method of the arcuate display device according to claim 8, further comprising:

driving the corresponding display units by a driver of the at least one controller according to the frame signals, wherein the driver is electrically connected between the frame signal generator and the display units.

10. The driving method of the arcuate display device according to claim 8, further comprising:

inserting the first dummy signals and the second dummy signals between the pixel signals.

11. The driving method of the arcuate display device according to claim 8, wherein each of the frame signals is a two-dimensional array signal formed by the pixel signals, the first dummy signals, and the second dummy signals, and the pixel signals are located between the first dummy signals and the second dummy signals.

12. The driving method of the arcuate display device according to claim 11, wherein the first dummy signals and the second dummy signals are arranged symmetrically relative to the pixel signals.

* * * * *